US010550648B2

(12) United States Patent
Gosselin

(10) Patent No.: US 10,550,648 B2
(45) Date of Patent: Feb. 4, 2020

(54) APPARATUS FOR RECIPROCATION AND ROTATION OF A CONVEYANCE STRING IN A WELLBORE

(71) Applicant: SLURRY SOLUTIONS INC., High River (CA)

(72) Inventor: Randy Gosselin, Calgary (CA)

(73) Assignee: Slurry Solutions Inc., Calgary (CA)

( * ) Notice: Subject to any disclaimer, the term of this patent is extended or adjusted under 35 U.S.C. 154(b) by 0 days.

(21) Appl. No.: 15/537,843

(22) PCT Filed: Dec. 17, 2015

(86) PCT No.: PCT/CA2015/051342

§ 371 (c)(1),
(2) Date: Jun. 19, 2017

(87) PCT Pub. No.: WO2016/095049

PCT Pub. Date: Jun. 23, 2016

(65) Prior Publication Data

US 2017/0370164 A1 Dec. 28, 2017

Related U.S. Application Data

(60) Provisional application No. 62/093,206, filed on Dec. 17, 2014.

(51) Int. Cl.

| | |
|---|---|
| ***E21B 17/07*** | (2006.01) |
| ***E21B 17/10*** | (2006.01) |
| ***E21B 33/14*** | (2006.01) |
| *E21B 17/08* | (2006.01) |

(52) U.S. Cl.
CPC ..... *E21B 17/1064* (2013.01); *E21B 17/1078* (2013.01); *E21B 33/14* (2013.01); *E21B 17/073* (2013.01); *E21B 17/08* (2013.01)

(58) Field of Classification Search
CPC ..... E21B 17/1064; E21B 17/073
USPC ..... 166/242.7
See application file for complete search history.

(56) References Cited

U.S. PATENT DOCUMENTS 4,678,031 A * 7/1987 Blandford ..... E21B 17/08 166/242.7
5,309,996 A 5/1994 Sutton

FOREIGN PATENT DOCUMENTS

WO 2015/143564 10/2015

* cited by examiner

*Primary Examiner* — Taras P Bemko
(74) *Attorney, Agent, or Firm* — Parlee McLaws LLP; C. F. Andrew Lau

(57) ABSTRACT

A telescopic tool is located intermediate a conveyance string and permits an uphole portion to be manipulated through reciprocation and rotation regardless of the fixed nature of a downhole portion. In embodiments, tools uphole of telescopic joint can be actuated by casing manipulation to aid in placement of cement. In other embodiments, such as during running into the wellbore, the tool can be selectively actuated to cause the uphole casing string to lock to, and rotate, the casing string located downhole.

15 Claims, 14 Drawing Sheets

APPARATUS FOR RECIPROCATION AND ROTATION OF A CONVEYANCE STRING IN A WELLBORE

FIELD

Embodiments disclosed herein relate to casing string joints, and more particularly to a telescopic casing string joint for reciprocation and rotation of a portion of a string for cementing, fracturing or other downhole operations.

BACKGROUND

It is common practice in the oil and gas industry to cement casing string within a wellbore after drilling the wellbore to depth by introducing cement into an annular space between the wellbore and the casing string. Cementing is often completed for various reasons including restricting fluid movement between formations and to bond and support the casing string within the wellbore. Cementing can be completed in stages, with staging tools fixed in the wellbore between cementing stages.

Cementing is typically performed by circulating cement slurry through an internal bore of the casing string from the surface to the bottom of the casing string and into the annulus through a casing string shoe located at the bottom of the casing string. Often, casing strings can also incorporate float shoes or float collars to prevent backflow of the cement slurry during cementing.

To ensure proper bonding between the casing string and walls of the wellbore, the casing string is centralized within the wellbore. Concentricity provides an annulus between the casing string and the wellbore. In ideal circumstances, the wellbore and the casing string would be substantially concentric so as to provide cement about the casing string having a uniform thickness.

In vertical wellbores, centralizers are spaced periodically along the casing string to sufficiently space the casing string away from the wellbore walls. The centralizers provide sufficient annular space between the casing string and the wellbore walls for the cement slurry during cementing operations.

In horizontal wellbores, or wellbores having a lateral section, the force of gravity acting on the casing string causes the casing string to rest or lay on the bottom surface of the wellbore wall reducing the effectiveness of centralizers. Thus, during cementing operations, the cement slurry, taking the path of least resistance will tend to travel along a top of the casing string, and often resulting in the cement slurry not being placed underneath the casing string. As a result, there are a plurality of locations along a horizontal or lateral section of a wellbore where bonding does not occur between the casing string and bottom surface of the wellbore. Lack of bonding along the casing string can result in surface gas migration that has become a multi-million dollar liability per year in the industry.

While centralizers can be deployed along the casing string for use in the lateral sections or along horizontal wellbores to space the casing string from the bottom wall of the wellbore, they are not particularly effective and a smaller annulus results thereunder. Any impetus for cement slurry to flow underneath the casing string is compromised. Thus, there may not be a placement of a sufficient amount of cement thereunder for bonding between the casing string and the bottom wall of a wellbore.

As set forth in U.S. Pat. No. 5,309,996 to Sutton, it is known to reciprocate an entire casing string during the placing of cement to prevent the loss of hydrostatic pressure in the cement slurry during the cement transition period from a true fluid to a gel sufficient to prevent gas migration therethrough. However, the casing string is limited in its manipulation by a hydraulic power unit at surface with a stroke of between 2 to 60 inches and preferably 8 to 10 inches. In order to prevent surging in the cement slurry as the casing is reciprocated, a slip joint is pre-charged with a compressible gas is connected to the bottom of the casing which is maintained in contact with the bottom of the wellbore. An alternate slip joint contains an insulated liquid nitrogen container to charge the slip joint with vaporized gas.

It is also known to rotate casing strings to aid in distribution of cement along and about the casing string, however, the massive weight of the casing string tends to impede cement distribution. Further, in staged cementing, once secured in the wellbore, movement of the casing string is impeded. Casing swivels are known for de-coupling the upper portion of the casing string from the lower portions and are limited to rotation during displacement and cementing operations.

Applicant has a co-pending application for a positive cement placement tool, filed as PCT/CA2015/050236, published as WO015/143564 on Oct. 1, 2015, designating the US, and claiming priority of U.S. 61/971,345 filed Mar. 27, 2014, the subject matter of which is fully incorporated by reference herein. Applicant's positive cement placement tool utilizes a reciprocating action of the conveyance string to rotationally actuate a particular form of bladed centralizer to provide positive impetus to urge cement slurry about the conveyance string. Applicant's tool disclosed therein teaches driving rotation of the placement tool in a first direction during an upstroke of the conveyance string, and the rotation of the tool in an opposite direction during a downstroke of the conveyance string. The oscillating movement or bi-directional rotation of the tool provides positive or additional impetus for urging cement slurry about the conveyance string.

Applicant's positive cement placement tool utilizes reciprocation of the conveyance string, however, where a staging tool or other device for securing the casing string in the wellbore, such as a downhole packer, is set and cannot be moved, or where the staging tool is already cemented into the downhole portion of the wellbore, the operation of such a tool is impeded or discouraged.

In another downhole operation, in multistage fracturing operations, a string of downhole tools are spaced along a completion or casing string and are run in hole to be fixed in the wellbore, by cementing or actuation of spaced packers to isolate zones of interest. As described above for cementing, further manipulation of the conveyance string is limited once a lower portion is secured in the wellbore.

In either of the two examples of conveyance strings above, having a portion of the string secured to the wellbore limits subsequent movement of remainder of the string and impedes subsequent operations and ultimately compromises integrity of the completion.

There are as yet unsolved challenges to manipulating a conveyance string uphole of secured downhole portions of the string, particularly in the greater depth and adverse gravity effects of horizontal wellbore environments.

SUMMARY

Herein, a tool is provided that permits a conveyance string such as casing string to be manipulated regardless of the downhole arrangement. Herein, casing string uphole of the present tool can be rotated and reciprocated at will. In embodiments, during run into the wellbore, the tool can be actuated to cause the casing string to lock to and rotate the casing string located downhole as well. Manipulation of the uphole portion of the casing string aids in completion activities, such as cement distribution, and in some instances, coupling of the uphole and downhole portions for co-rotation can aid in run-in operations, such as to clear debris or pass washouts. The reciprocation of the uphole string is well adapted to actuate cement placement tools including Applicant's helically driven placement tools.

A telescopic tool is provided with the ability to permit movement of a casing string, uphole of a packer or other restriction to movement, is provided. Herein, the tool is a telescopic casing string joint located between surface and a point of restricted movement between the casing string and the wellbore. The telescopic casing string joint comprises a tubular sleeve of a first diameter having a tubular mandrel with a diameter smaller than the first diameter, fit slidably therein. The mandrel is fluidly sealed to the sleeve by a coupling, and the sleeve can slidably move along a longitudinal length of the mandrel. In an embodiment, the sleeve is adapted at an uphole end for fluidly connecting to a conveyance string, and the mandrel is adapted at a downhole end for fluidly connecting to downhole equipment, such as staging tools and packers. In other embodiments the male mandrel and female sleeve arrangement can be reversed.

In operation, the telescopic casing string is operatively and fluidly connected to and within a conveyance string.

In an embodiment, such as for staged cementing operations, the conveyance string is a casing string and a downhole portion thereof is fit with a float shoe or staging tool including an annular packer. The telescopic joint is fit uphole of the staging tool and generally adjacent thereto. The conveyance string can be run downhole to a desired depth and the packer set, securing the downhole portion of the casing string to the wellbore. As the sleeve can move and rotate along and about the length of the mandrel, the telescopic joint permits an uphole portion of the casing string to be reciprocated and rotated, such as to distribute cement thereabout. Thus, the uphole portion of the casing string and any other tool associated therewith can be actuated either by reciprocation or by rotation of the casing string.

In one broad aspect a method is provided for cementing a casing annulus about a casing string completed in a wellbore, the casing string having an uphole portion located uphole of a downhole portion. One locates at least one staging tool between the uphole and downhole portions of the casing string. Then one runs the casing string into the wellbore and secures the staging tool in the wellbore, actuates the staging tool to block the casing annulus at the staging tool and block the downhole portion of the casing string from the uphole portion, and then places cement through the uphole portion and out of the staging tool into the casing annulus along the uphole portion of the casing. The uphole portion of the casing string is reciprocated to place the cement about the upper portion.

In another broad aspect a method if provided for placing cement in an annulus about a casing string completed in a wellbore. The casing string has an uphole portion located uphole of a downhole portion. One spaces one or more cement placement tools along the uphole portion and runs the casing string into the wellbore for positioning the lower portion. One then places cement through the uphole portion and into the casing annulus along the upper portion of the casing and reciprocates the upper portion relative to the lower portion to place the cement thereabout. In a broad aspect, an apparatus is provided for permitting reciprocation and rotation of a portion of a conveyance string uphole thereof. The apparatus has a tubular sleeve, a tubular mandrel slidably fit within the tubular sleeve, and a coupling for fluidly sealing the tubular mandrel to the tubular sleeve.

In another broad aspect, a telescopic casing tool positioned intermediate a uphole portion and a downhole portion of a casing string. The tool comprises an inner mandrel having a first bore adapted to be fluidly connected with the casing string and an outer sleeve having a second bore adapted to be fluidly connected with the casing string. The second bore of the outer sleeve is telescopically slidable about the inner mandrel between fully retracted and extended positions. In an embodiment, a locking mechanism is provided between the outer sleeve and inner mandrel for co-rotation of the uphole and downhole portions in the fully retracted position and released for rotation in the extended position. In another embodiment the upper portion of the casing string is fit with two or more axially-actuated cement placement tools.

DESCRIPTION OF THE PREFERRED EMBODIMENTS

Figure 1A:
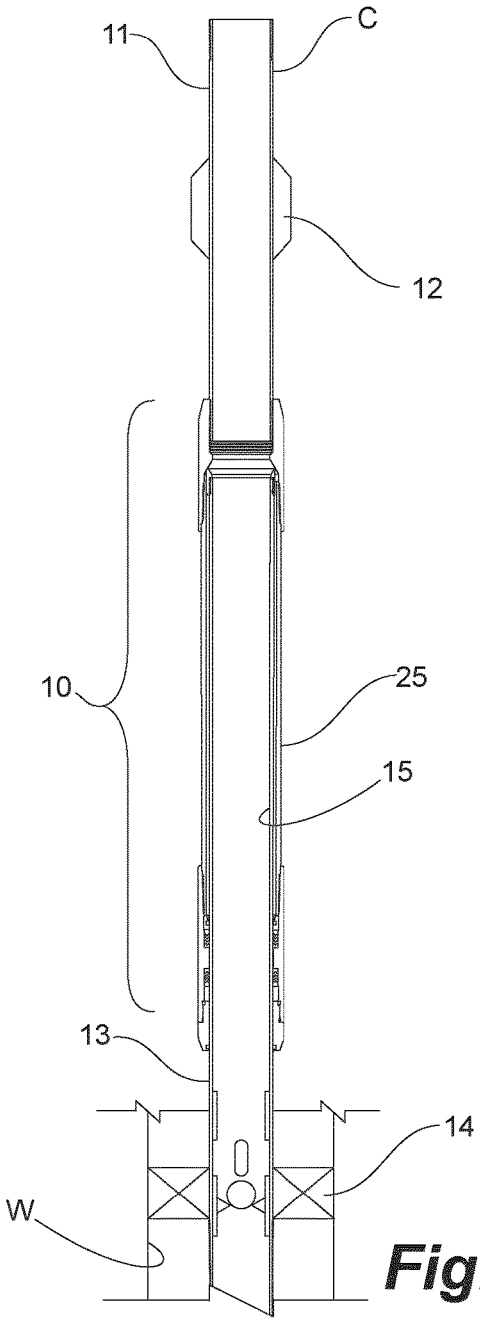
FIG. 1A is a side cross-sectional view of an embodiment of a telescopic casing string joint in its retracted position, a centralizing tool uphole of the telescopic casing string joint and a casing string packer downhole of the telescopic joint.
Figure 1B:
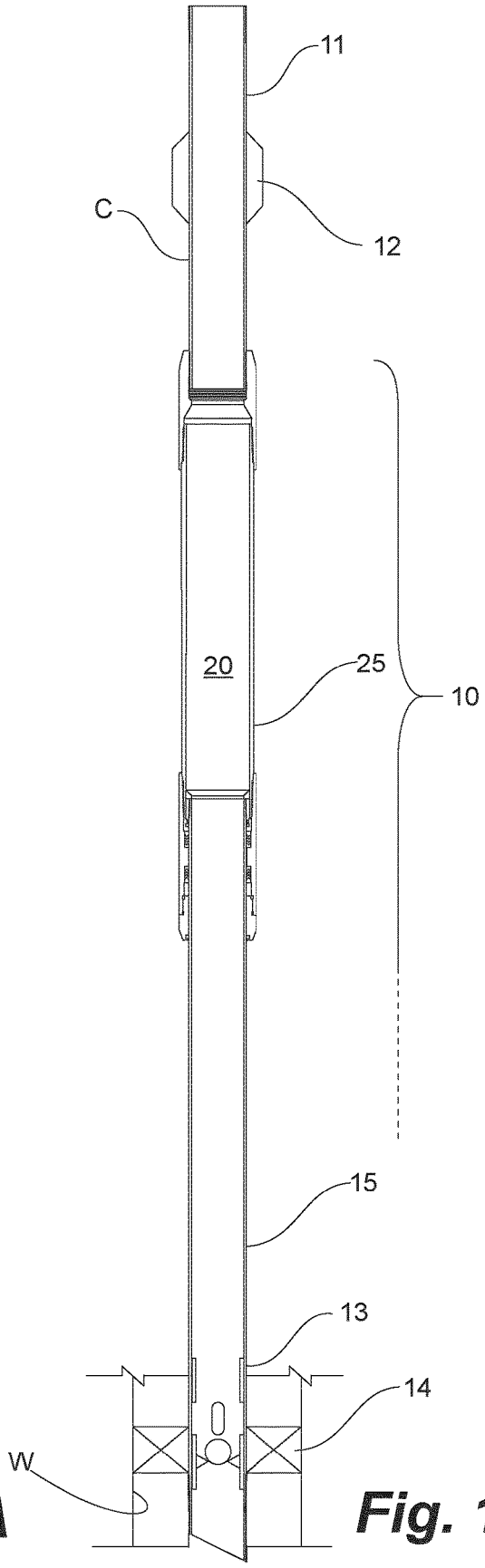
FIG. 1B is a side cross-sectional view of the embodiment of FIG. 1A in its extended position.

With reference to FIGS. 1A and 1B, an embodiment of a telescopic joint 10 is fluidly connected intermediate a casing string C. In this embodiment, the casing string C is positioned within a wellbore W and the downhole portion 13 is fit with a staging tool, or packer, or both 14 collectively. The downhole portion 13 of the casing string can be secured in the wellbore W therein by the packer 14. An uphole portion 11 of the casing string C is axially movable and can be rotatable with respect to the downhole portion 13. Axial and rotational movement is provided through the telescopic joint 10. The term uphole is generally interchangeable with the terms upper or upwards depending on the context, and is used for consistency when a wellbore transitions from vertically-extending to more laterally-extending or horizontal and when upper and upward no longer assist with orientation.

The telescopic joint 10 comprises a tubular inner mandrel 15 having a first bore adapted to be fluidly connected with the casing string C. A outer sleeve 25 has a second bore 20, adapted to be fluidly connected with the casing string C, the second bore being telescopically slidable about the inner mandrel 15 between fully retracted and extended positions.

Accordingly, the inner mandrel 15 is slidably fit within the second bore 20 of the tubular outer sleeve 25, the outer sleeve 25 being slidably movable along the length of the inner mandrel 15. In this embodiment the inner mandrel 15 is connected to the downhole portion 13 and the outer sleeve 25 to the uphole portion 11. The inner mandrel and outer sleeve are fit with complementary stops to delimit axial movement and axially retain one to the other.

As shown, FIG. 1A illustrates the outer sleeve 25 telescopically collapsed over the inner mandrel 15 into a fully retracted position and FIG. 1B illustrates the outer sleeve 25 pulled into an extended position. The extended position can be any range of motion between the fully retracted and a fully extended position as shown.

Figure 2:
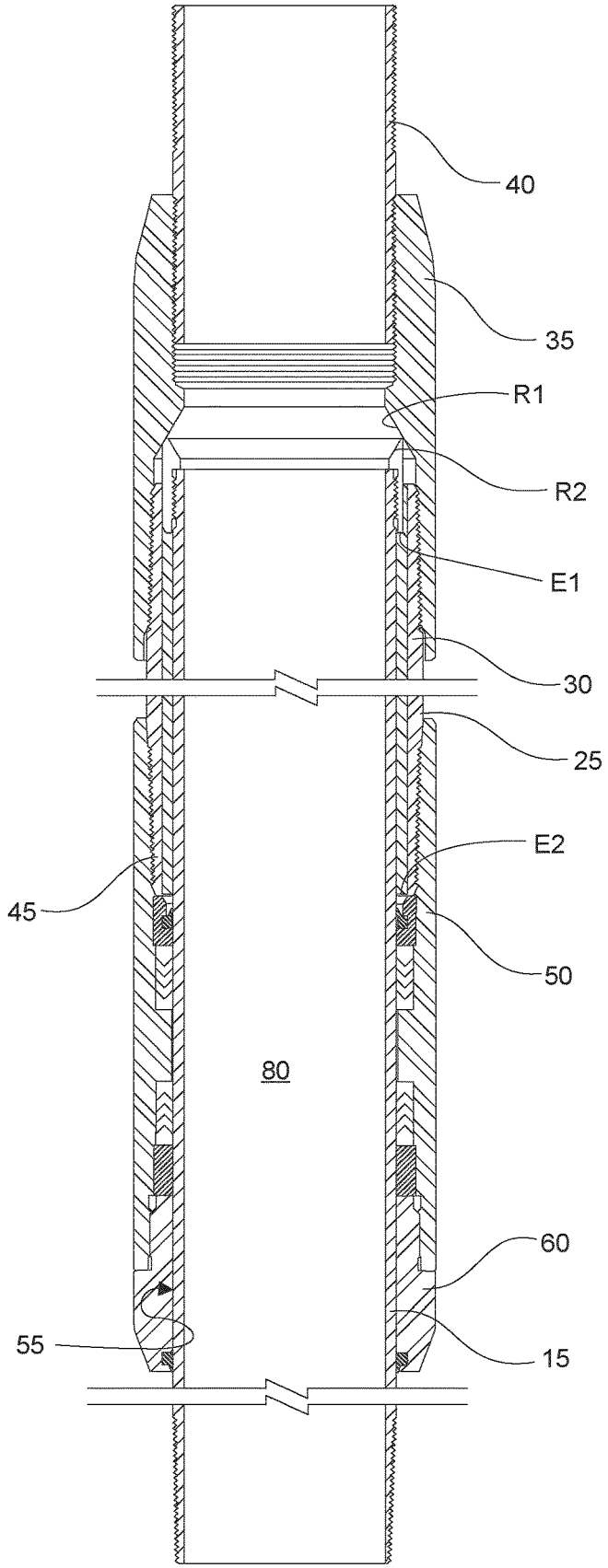
FIG. 2 is an enlarged side cross-sectional view of the embodiment of FIG. 1A, illustrating in greater detail the sealing sub.

With reference to FIG. 2, the telescopic joint is secured within a casing string C. A coupling end or uphole end 30 of the outer sleeve 25 is joined to the uphole portion 11 of the casing string C by a tubular coupling 35. A sliding or downhole end 45 of the outer sleeve 25 is coupled to a tubular sealing sub 50 for slidably and sealingly engaging an outer surface 55 of the inner mandrel 15. The inner mandrel 15 sealably and slidably reciprocates within the bore 20 of the outer sleeve 25 and is joined to the downhole portion 13 at its coupling end 37.

Figure 3:
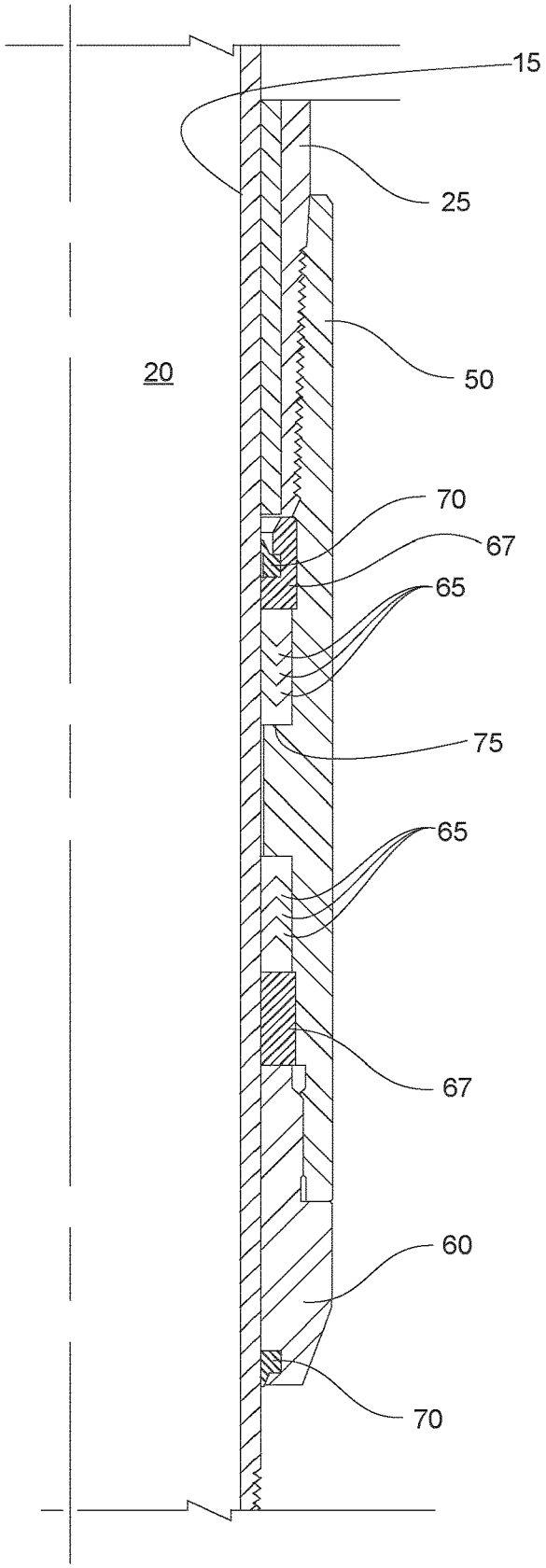
FIG. 3 is an enlarged side cross-sectional view of the sealing sub and end cap of FIG. 2.

With reference to FIG. 3, in one embodiment of a sealing interface or annulus between the inner mandrel 15 and the outer sleeve 25, a sealing sub 50 is provided comprising at least sealing elements 65 for sealing against the inner tubular mandrel 15. Sealing elements 65 comprise one or more sets of annular sealing elements. As shown, two sets of annular sealing elements 65 are spaced axially. Suitable for high pressures associated with fracturing each set of Vee-pack seals comprises 4 Vee or chevron seals, operating together to manage pressure differentials in the order of 20,000 psi. Further, the sealing interface comprises two or more annular sliding elements 67 and wiper seals 70 both of which protect the sealing elements 65. An outer surface 55 of the mandrel 15 that interfaces with the sealing elements during manipulation can be polished.

More particularly, the sealing interface comprises the sealing elements 65 positioned axially between uphole and downhole wiper seals 70. The wiper seals 70 are adjacent uphole and downhole ends of the sealing sub for wiping the polished outer surface of the inner tubular mandrel 15 to exclude a majority of debris from entering the sliding interface and protect the sealing elements 65.

The sliding elements 67 are also located between the wiper seals 70 and provide dimensional stability to the sliding surfaces 15,25 so as to extend the sealing integrity of the sealing elements 65. The sealing elements 65 are sandwiched axially between two of the two of more sliding elements 67.

The sealing sub 50 comprises a tubular housing having annular recesses for supporting the sealing elements 65, the sliding elements 67 and the wiper seals 70. The sealing sub 50 supports an annular upset 75 extending radial inwardly for separating and supporting uphole and downhole interface components. An end cap 60, fit to a downhole end of the sealing sub 50, secures downhole sealing and sliding elements within the sub 50 and uphole, the outer sleeve coupling to the sub 50 secures uphole sealing and sliding elements therein.

The sealing sub is sandwiched between the outer sleeve 25 and the end cap 60 and retains the sealing and sliding elements 65,67 therebetween. From the downhole end, the end cap 60 is fit with a wiper seal 70 and between the end cap 60 and outer sleeve 25, the sub 50 supports a downhole sliding element 67, a downhole sealing element or elements 65, the annular upset 75, an uphole sealing element or elements 65, and uphole sliding element 67 and a wiper element integrated or supported by the sliding element 67. A threaded coupling of the outer sleeve 25 and sealing sub 50 retainably sandwiches the upper sliding element and sealing elements 65 against the annular upset 75.

Returning to FIG. 2, the inner mandrel 15 is delimited or retained at the extents of its longitudinal or axial range of motion. The uphole end 30 of the inner mandrel 15 is threadably fit with a top cap 32. In the retracted position, the top cap 30 engages the tubular coupling 35 at stops R1, R2, an upper shoulder of the top cap 32 engaging an inner shoulder of the tubular coupling 35. In the extended position, the top cap 30 engages the sealing sub 50, such as at stops E1, E2, a downhole shoulder of the top cap 32 engaging an inner shoulder of the sealing sub 50.

With reference to FIGS. 4A to 11, in another embodiment of the telescopic joint 10, the sealing sub 50 and stop arrangement E1,E2 is modified from that described above. Further, an option is added to selectively and mechanically lock or couple the rotatable uphole portion with the lower portion of the casing string.

Figure 4A:
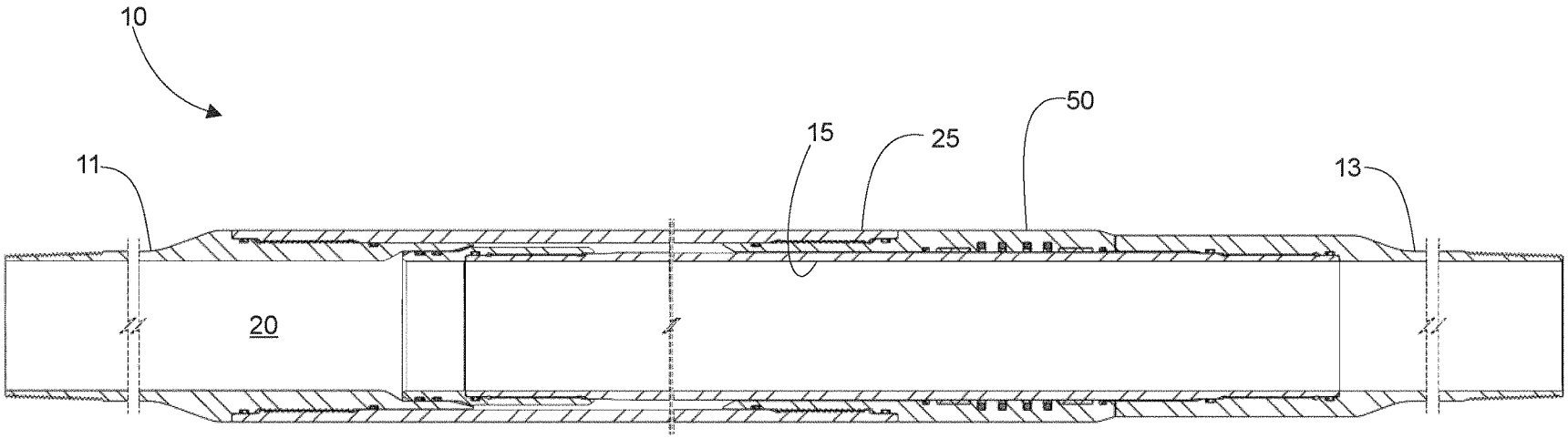
FIG. 4A is a cross-sectional view of another embodiment of a telescopic casing string joint in its retracted position.
Figure 4B:
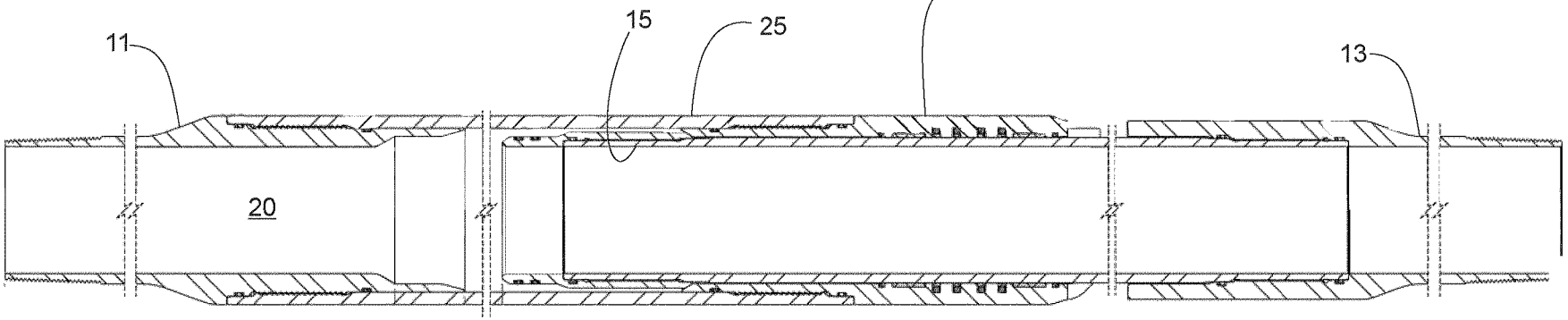
FIG. 4B is a cross-sectional view of the embodiment of FIG. 4A in its extended position.

With reference to FIGS. 4A and 4B, an uphole end 30 of the outer sleeve 25 comprises a female-to-male coupling 35, joined at a downhole female end to the outer sleeve and at a male uphole end to the uphole portion 11 of the casing string C. A downhole end 45 of the outer sleeve 25 is coupled to the tubular sealing sub 50. Again, the inner mandrel 15 sealably and slidably reciprocates within the bore 20 of the outer sleeve 25. A downhole end of the inner mandrel 15 is coupled to a female-to-male coupling 37. In the retracted position, such as during run in, a downhole end of the sealing sub 50 engages an uphole end of the coupling 37. Simultaneously, an uphole end of the inner mandrel 15 sealably engages the coupling 35. As shown in FIG. 4B, in the extended position, the downhole end of the sealing sub 50 separates from the uphole end of the coupling 37 and the uphole end of the inner mandrel 15 separates from coupling 35.

Figure 5A:
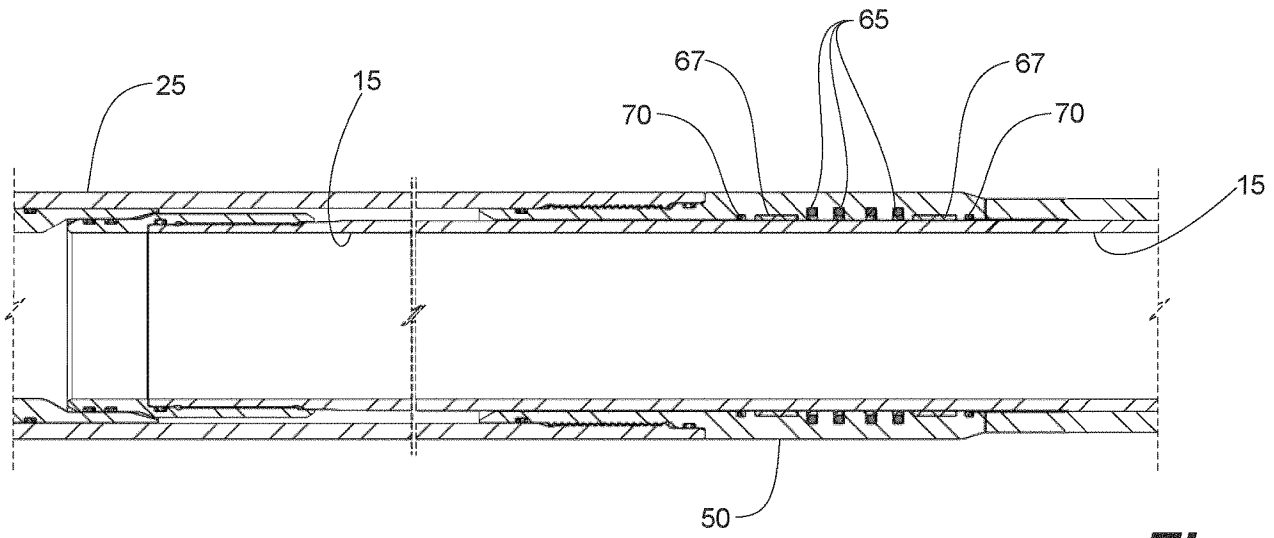
FIG. 5A is an enlarged cross-sectional view of the telescopic interface of the casing string joint of FIG. 4A.
Figure 5B:
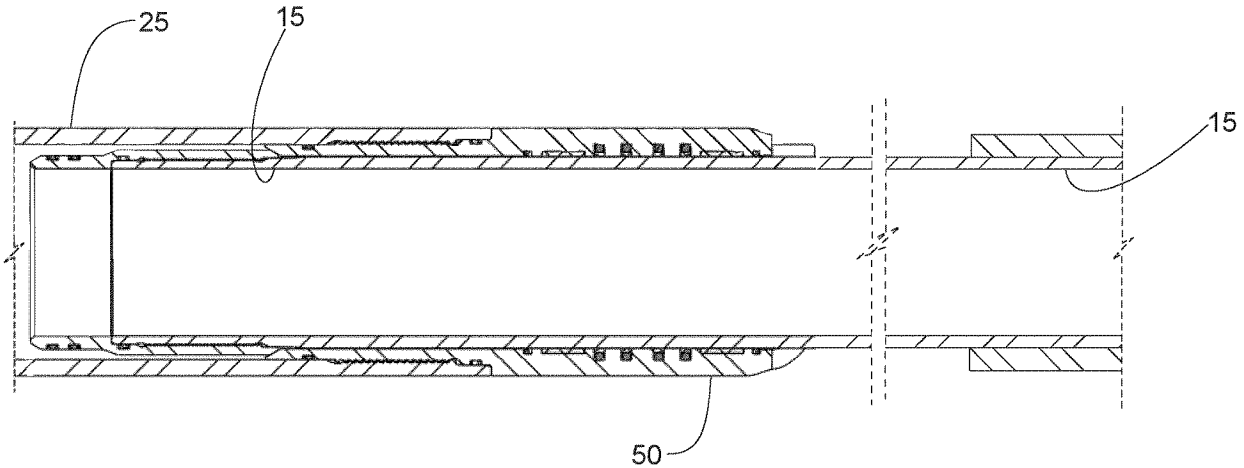
FIG. 5B is an enlarged cross-sectional view of the telescopic interface of the casing string joint of FIG. 4B.

With reference to FIGS. 5A and 5B, in another embodiment of the sealing interface between the inner mandrel 15 and the outer sleeve 25, the sealing sub 50 again comprises sealing elements 65 for sealing against the inner tubular mandrel 15.

Sealing elements 65 comprise one or more sets of annular sealing elements. As shown, four lip-type piston rod seals 65 are spaced axially along the sealing sub 50. The sealing elements 65 can be twin lip, rod seals such as a PTFE and FKM thermoset elastomer combination. The annular sealing elements 65 are sandwiched axially between annular sliding elements 67 and wiper seals 70. The sliding elements 67 act as wear elements such as that formed of PTFE. The wiper seals 70 can be formed of rod wipers.

The sealing sub 50 threadable coupled with the outer sleeve 25 and sealed thereto with Viton™ O-rings.

Figure 6:
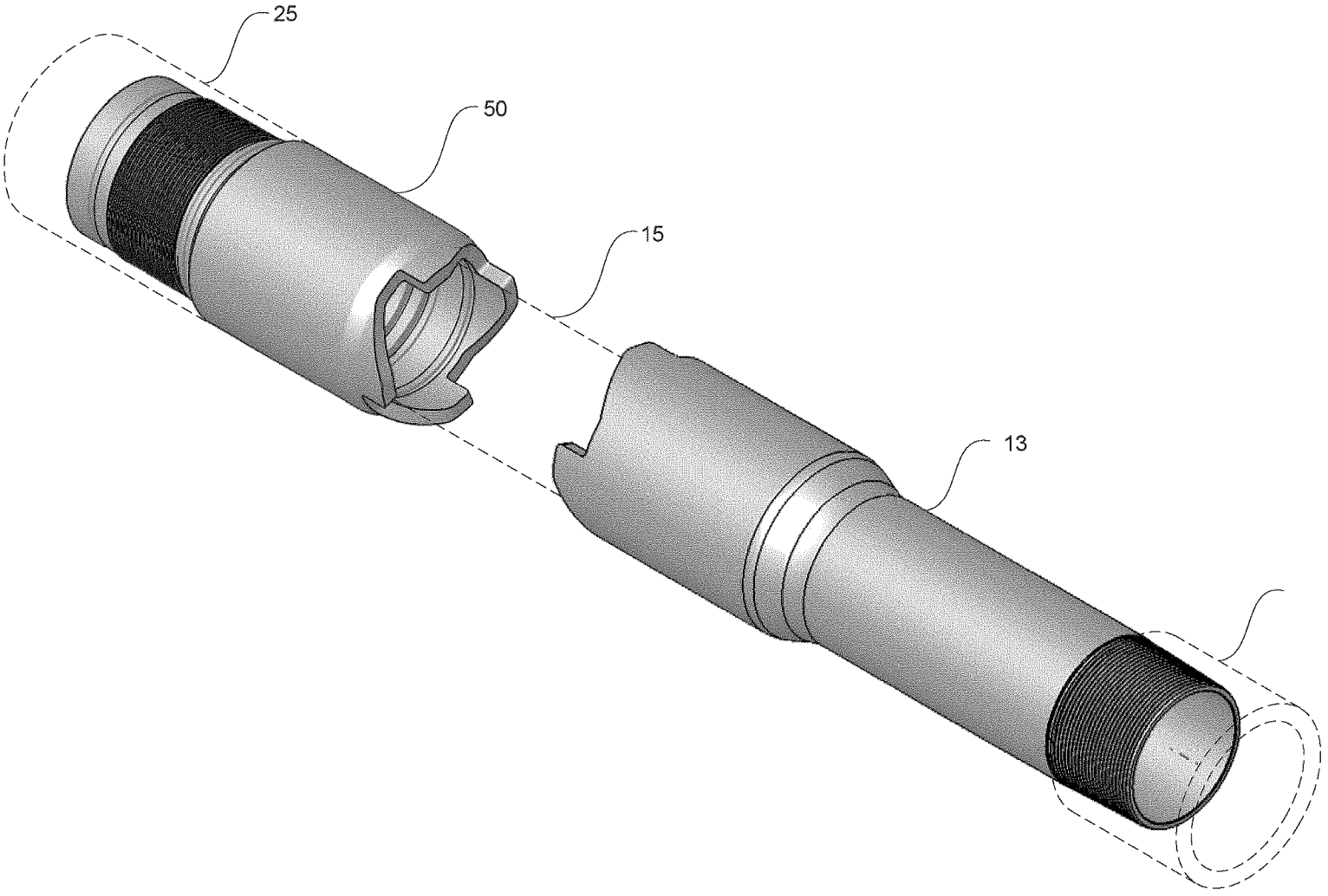
FIG. 6 is a perspective view of a lock off interface at downhole end of the telescopic casing string joint of FIG. 4A.
Figure 7:
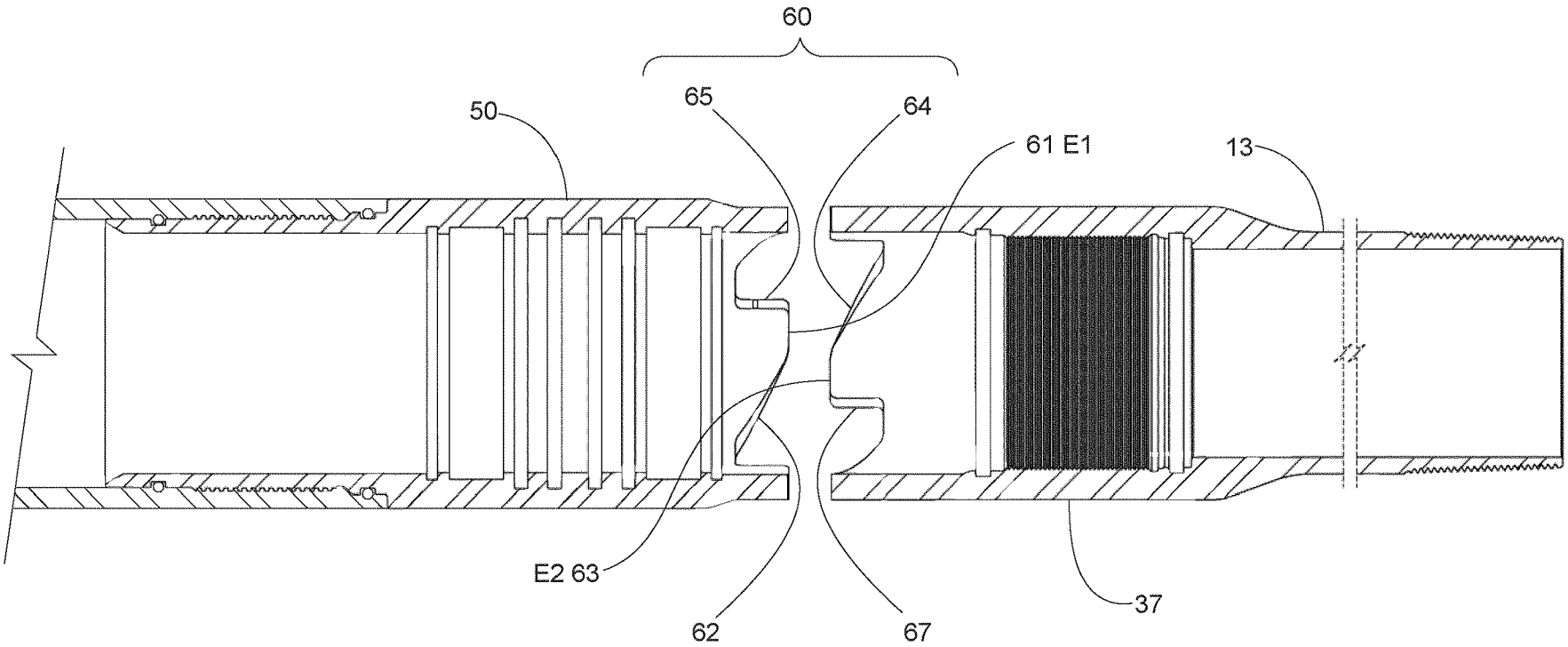
FIG. 7 is a cross-sectional view of the perspective view of a lock off interface of FIG. 6.

With reference to FIGS. 5B, 6, and 7, and as illustrated for the embodiment of FIGS. 4A-11, a locking mechanism 60 is provided between the outer sleeve 25 and inner mandrel 15, and fit between the sealing sub 50 and coupling end 37, for selectable coupling of the uphole and downhole portions of the casing string C, enabling co-rotation of the uphole and downhole portions in the fully retracted position and released for rotation in the extended position. While the telescopic joint 10 is available for de-coupling the uphole and downhole portions, there are instances where an operator may wish to lock the portions together for co-rotation.

Figure 11:
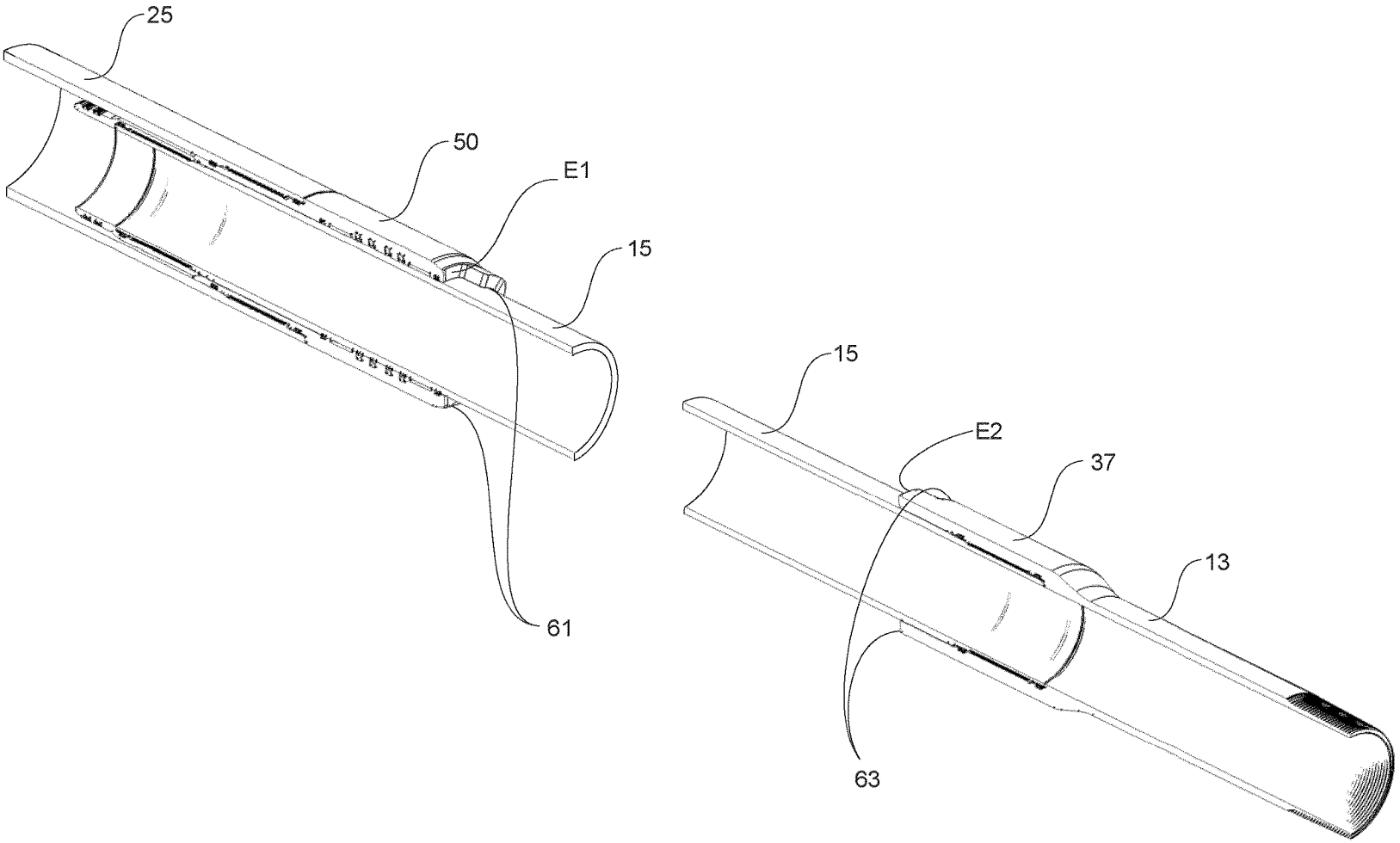
FIG. 11 is a partial cross-sectional and perspective view of the downhole end of outside sleeve and sealing sub according to FIGS. 10A and 10B with the inner mandrel fully extended from the outer sleeve.
Figure 12:
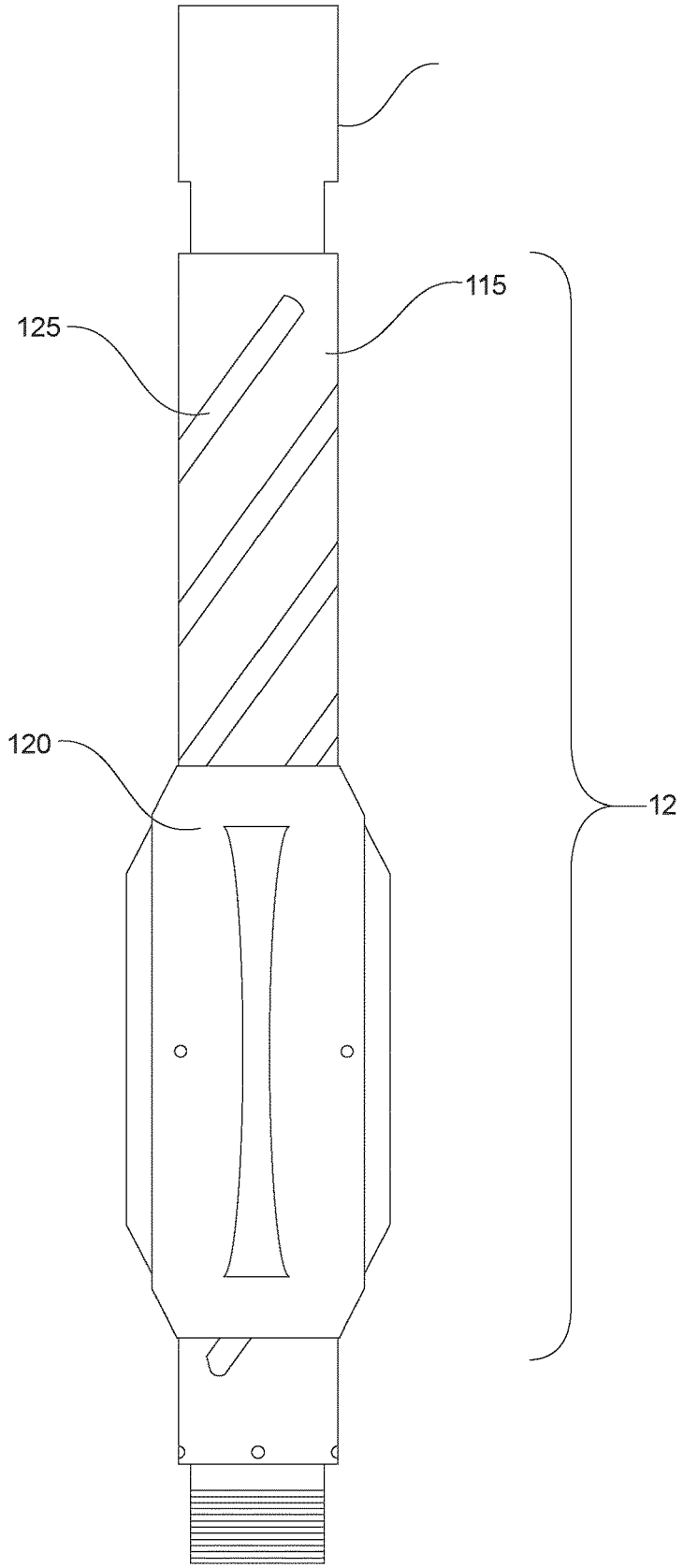
FIG. 12 is a side view of an embodiment of a positive placement tool of WO015/143564, to Applicant, illustrating a mandrel sleeve secured to a section of a casing string, a rotatable centralizer, and helical grooves on the mandrel sleeve forming a portion of a helical drive arrangement.

As shown best in FIGS. 7 and 11, a downhole end E1 of the sealing sub 50 is formed with a first one-way clutch profile 61 and the downhole coupling 37 of the inner mandrel 15 is fit with a second complementary clutch profile 63. The respective clutch profiles comprise unidirectional, interlocking cog-like interface having cooperating ramped faces 62, 64 for release and axial lock faces 65, 67 for co-driving and rotating the downhole coupling 37 and downhole portion of the casing string 13 clockwise. Locking mechanism 60 engages stops E1 and E2 when the tool is in the fully retracted position and locking faces 65,67 engage for co-rotation in the clockwise direction. The ramp faces 62,64 ensure separation in counter-clockwise rotation.

During running in, or in operations in which the downhole portion 13 of the casing string is not fixed or secured to the wellbore W, there may be a desire to rotate the downhole portion such as to lessen drag, or to assist the downhole end of the string to overcoming cave-ins or climb out and over washouts. Accordingly, in the fully retracted position, the downhole end E1 of the outer sleeve 25 and the downhole coupling 37 of the inner mandrel couple and enable co-rotation of the downhole portion 13 with the uphole portion 11 when engaged and the casing string C is rotated clockwise.

In embodiments where the telescopic joint is oriented in the opposite direction, the inner mandrel is fluidly connected to the uphole portion and the outer sleeve to the downhole portion. The sealing sub 50 is now facing uphole and can be subject to debris accumulation; any debris cleaned free of the inner mandrel by wiper seals 70. Accordingly, the phraseology for orientation of uphole and downhole ends could read more generically as sliding end 45 at the sealing sub 50 of the outer sleeve 25, now oriented uphole, and a coupling end of the inner mandrel 15 is fit with a casing coupling 37, now also oriented uphole. The outer sleeve 25 is also now connected to the downhole portion of the casing string at casing coupling 35, now at the downhole end.

EXAMPLE

For use with a 4.5 inch casing string C, an embodiment of the telescopic casing string joint can comprise a 5.5 inch outer tubular sleeve (such as either a 5.5 inch flush casing string joint or a 5.5 inch conventional casing string joint).

Referring back to FIG. 2, the cross-over coupling 35, adapted to fluidly connect with a downhole end of the 4.5 inch casing string, is supported by an uphole end 30 of the tubular sleeve 25. The tubular coupling 35 permits a flow fluid path to be contiguous from a bore of the casing string, through the bore 20 of the outer tubular sleeve 25, and through a bore 80 of the inner tubular mandrel 15.

Figure 8A:
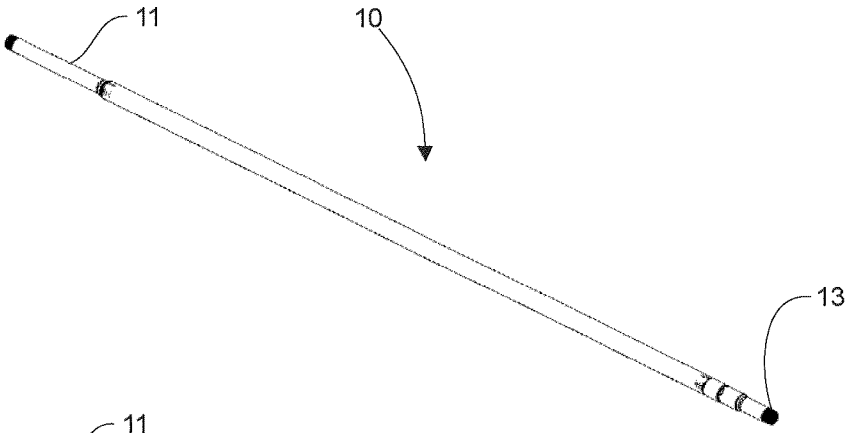
FIGS. 8A and 8B illustrate perspective view of the assembled telescopic joint of FIG. 4A in the retracted and extended positions respectively.
Figure 8B:
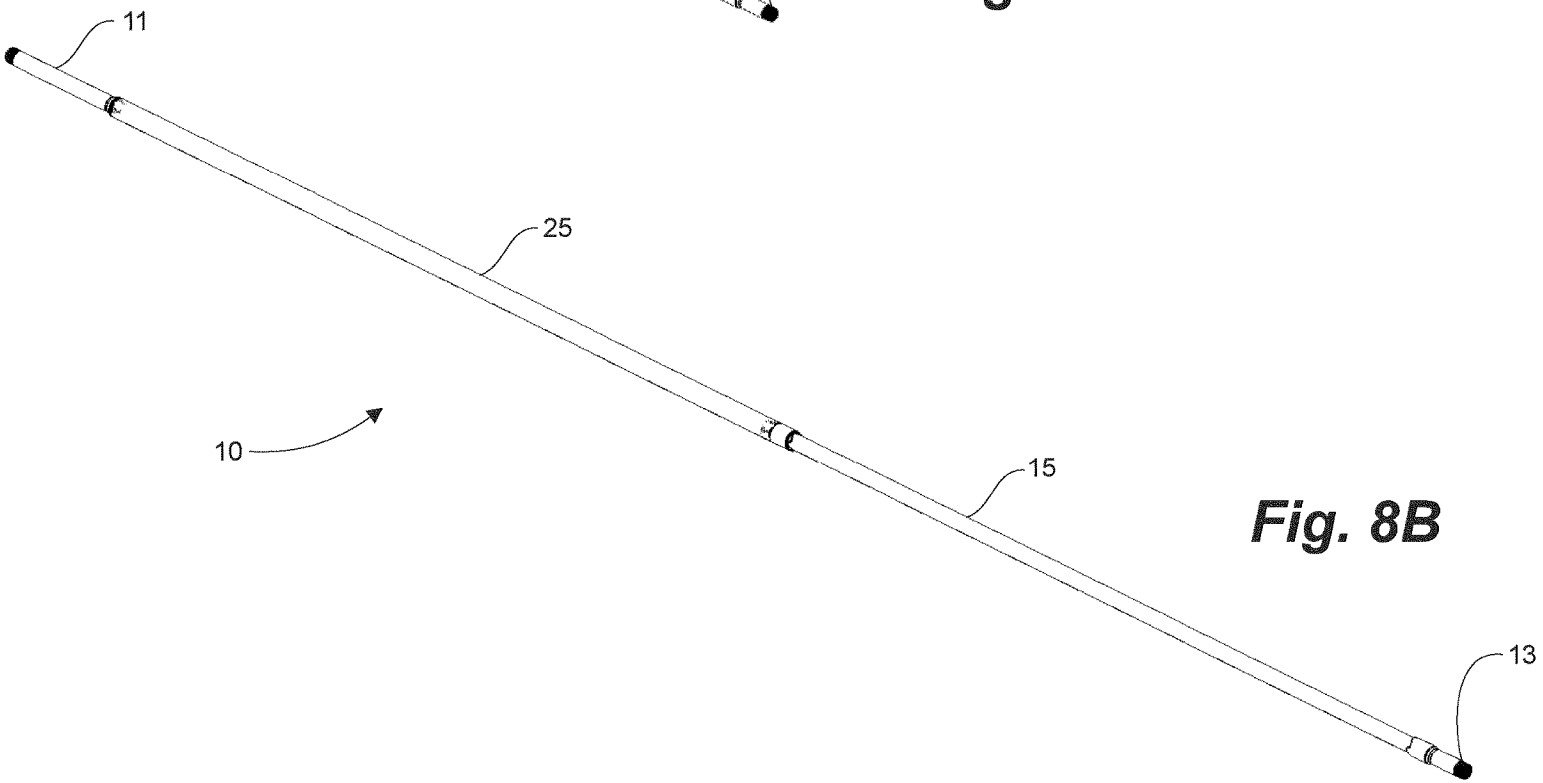
Figure 9A:
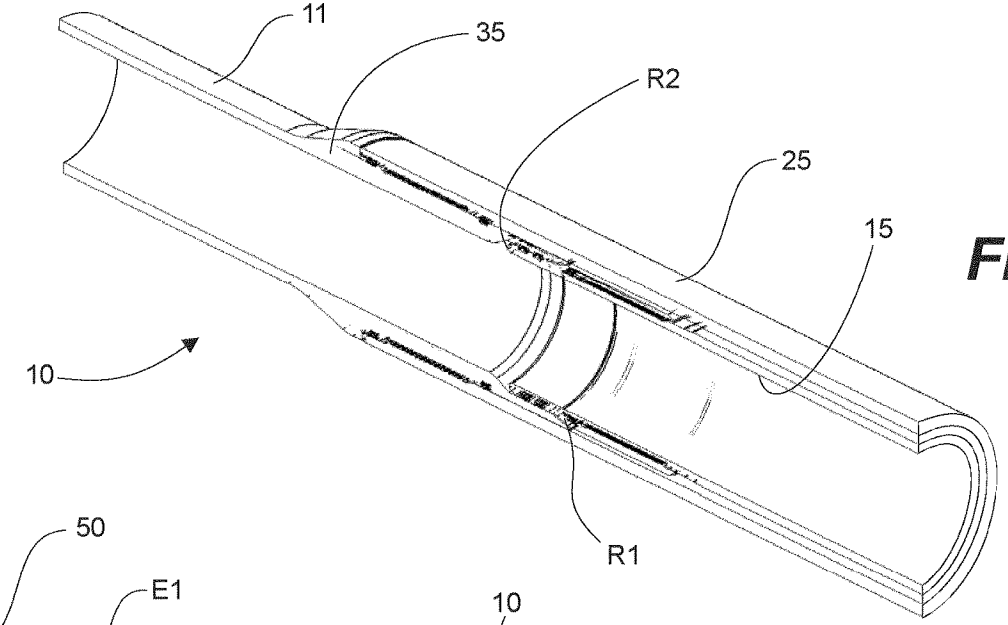
FIGS. 9A and 9B are partial cross-sectional and perspective views of the uphole and downhole ends of the telescopic joint of FIG. 8A, the inner mandrel fully retracted into the outer sleeve.
Figure 9B:
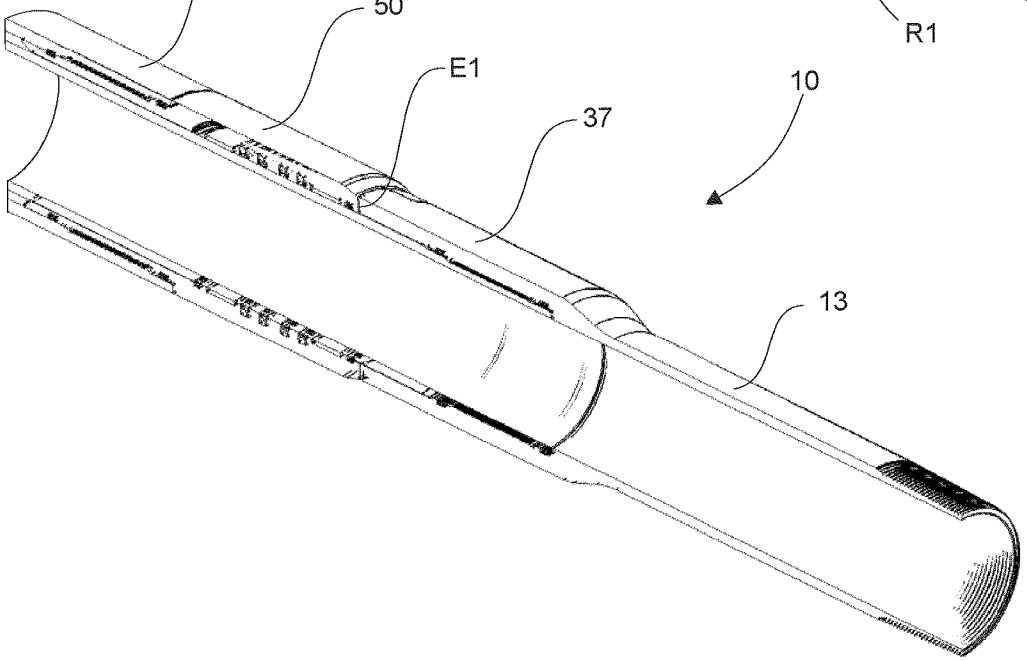
Figure 10A:
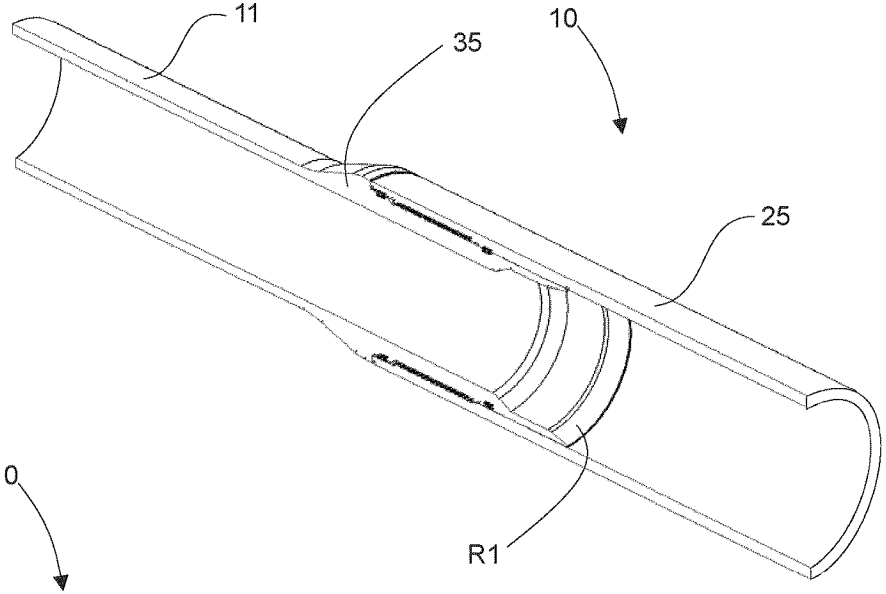
FIGS. 10A and 10B are partial cross-sectional and perspective views of the uphole and downhole ends of the telescopic joint of FIG. 8A respectively, the inner mandrel fully extended from the outer sleeve.
Figure 10B:
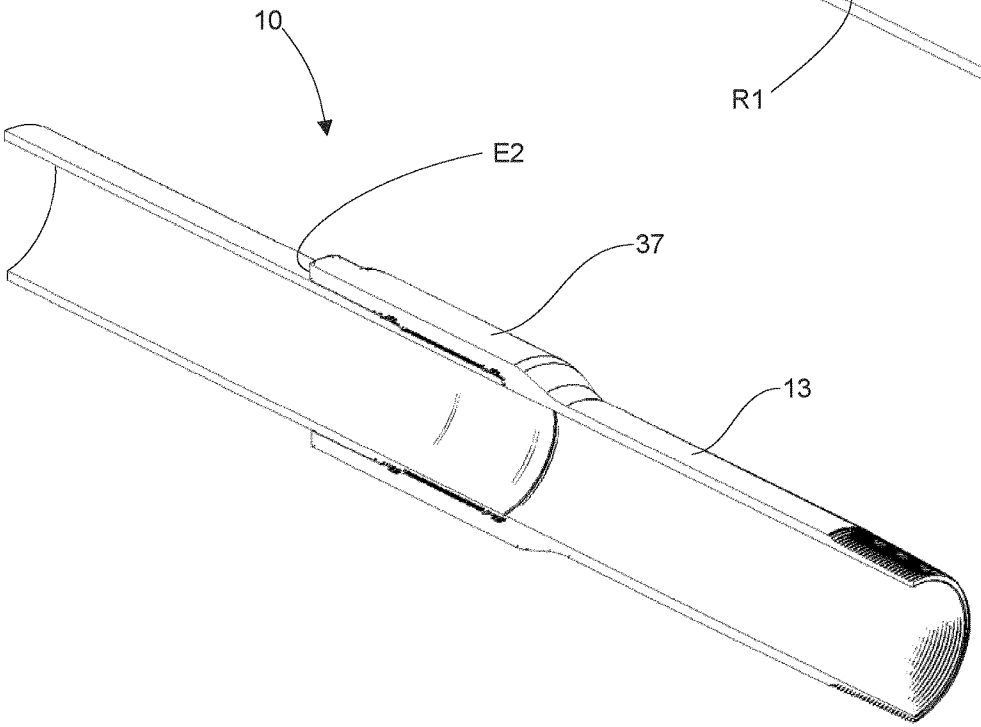

As shown in FIG. 2, a 4.5 inch inner tubular mandrel, such as either a 4.5 inch flush casing string joint or a 4.5 inch conventional casing string joint, is slidably fit within the bore of the 5.5 inch outer tubular sleeve. The sealing sub 50 is operatively connected to a downhole end of the 5.5 inch outer tubular sleeve 25 and is adapted to sealingly engage an outer surface 55 of the 4.5 inch inner tubular mandrel 15. The outer surface of the inner tubular mandrel 15 is polished to maximize sealing and pressure rating. Four lip-type piston rod seals provide sealing at up to about 20,000 psi. As shown in FIGS. 8A and 8B, for 4.5 inch casing, an axial reciprocation of about 20 feet is available.

In the embodiment of FIGS. 1A-3, the end cap 60 secures the sealing and sliding components within the sealing sub 50. The inner mandrel and outer sleeve have stops E1,E2 to prevent separation of the inner mandrel 15 from the outer sleeve. In an embodiment, the sealing sub 50 forms an internal shoulder E2 for engaging a complementary shoulder E1 of the inner mandrel 15.

Operation

With reference to FIGS. 1A, 1B, 8A and FIGS. 12-14B, an embodiment of the telescopic casing string joint 10 can be delivered to an end user in its retracted position (FIG. 8A), the inner mandrel 15 retracted within the outer sleeve 25.

The telescopic casing string joint 10 can be fluidly connected above a downhole portion 13 of a casing string C and to downhole tools, such as stage tools and packers 14. One of more additional tools can be inserted along the uphole portion 11 of the casing string, including those tools 12 that benefit from actuation through casing string reciprocation. Once a complete casing string C is formed at surface, the casing string C, including the telescopic casing string joint 10 and downhole tools 14 can be run in the wellbore W. Upon reaching a desired depth, the staging tool 14 can be actuated for setting packer 14 downhole of the telescopic joint 10, thereby blocking the casing annulus at the staging tool 14 and blocking the downhole portion 13 of the casing string from the uphole portion 11, and downhole operations such as cementing can commence. During or after downhole operations, if the need to stroke or rotate the casing string arises, the telescopic casing string joint can permit both of these actions.

As the inner mandrel 15 is operatively connected to the packer downhole, and is therefore immobile, then during an uphole stroke of the uphole portion 11 of the casing string C, the outer sleeve 25 can be axially actuated to slidably move in an uphole direction relative to the immobile inner mandrel 15. In a downhole stroke, the outer sleeve 25 is actuated to slidably move in a downhole direction relative to the immobile inner mandrel 15. Further, the inner mandrel 15 permits the outer sleeve 25 to slidably rotate thereabout, further permitting the portion of the uphole portion of the casing string S to rotate.

During running in, or in operations in which the downhole portion 13 of the casing string is not fixed or secured to the wellbore W, there may be a desire to rotate the downhole portion such as to lessen drag, or to assist the downhole end of the string to overcoming cave-ins or climb out and over washouts. Accordingly, if so specified and assembled prior to run in operations, the downhole end of the outer sleeve 25 and the downhole end of the inner mandrel are fit with the annular clutch. The clutch enables co-rotation of the downhole portion with the uphole portion when engaged and the casing string C is rotated clockwise.

As discussed above, the telescopic joint 10 permits reciprocation of the uphole portion 11 of the casing string C. On form of uphole tool 12, such as a conventional centralizers, when able to either freely rotate about a casing string or not rotate at all, have not been found to effectively provide the positive impetus to move, positively direct, or otherwise force cement slurry about and along the casing string, particularly under the casing string.

With reference to FIGS. 12, 13 and FIGS. 14A, 14B, and as disclosed in Applicant's International application published as WO2015/143564 on Oct. 1, 2015, a positive cement placement tool 12, disposed along the uphole portion 11 of the casing string C, located within laterally extending or horizontal sections of the wellbore W, can mechanically provide a positive impetus for positively directing or forcing the injected cement slurry about and along the casing string C. In embodiments, the displacement tool 12 can comprise a centralizer 120, which can be actuated to rotate about the casing string C, for forcing the injected cement slurry around and along the casing string. In embodiments, the centralizer 120 of the placement tool 12 can be actuated to rotate the centralizer in a first direction and then in a second opposite direction by the reciprocal uphole and downhole stroking of the casing string C, for mechanically providing positive impetus to force the cement slurry around and along the casing string.

In a broad aspect, one can spaces one or more cement placement tools 12 along the uphole portion 11 before running the casing string C into the wellbore W for positioning the lower portion 13. Thereafter, one proceeds to places cement through the uphole portion and into the casing annulus along the upper portion of the casing string, between the casing string C and the wellbore W, then reciprocating the telescopic joint for reciprocating the upper portion relative to the lower portion to place the cement thereabout.

Figure 13:
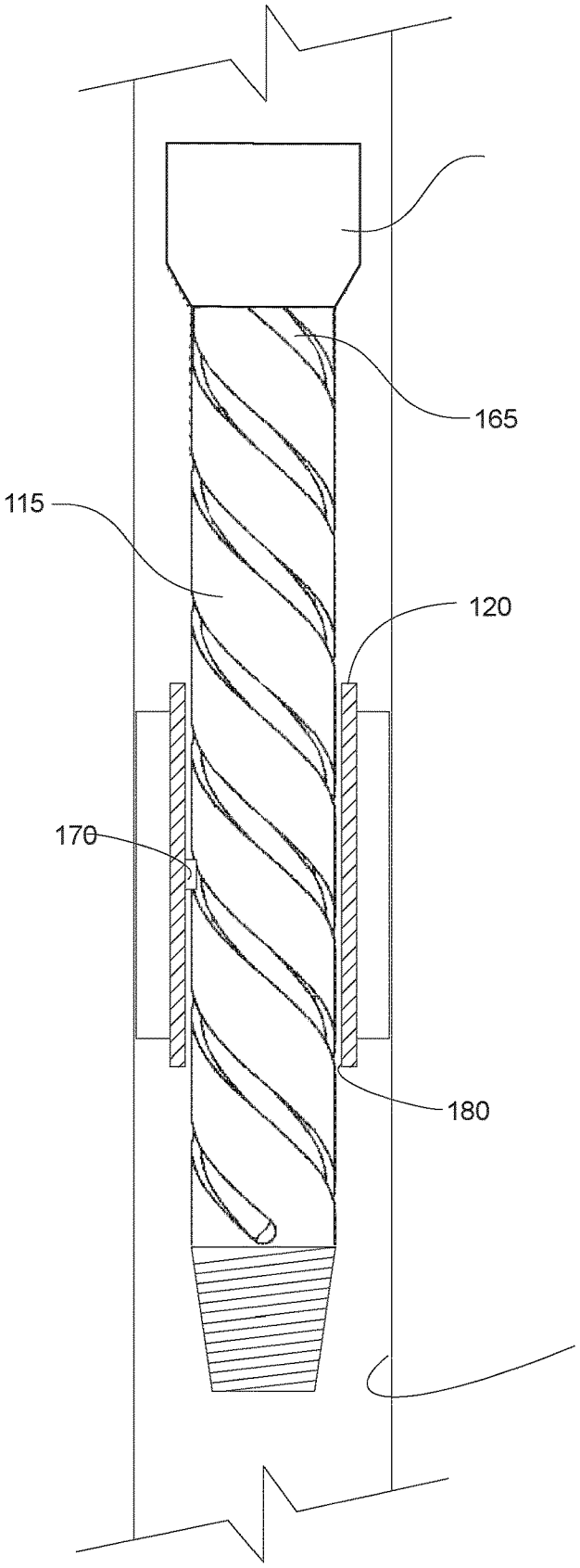
FIG. 13 is a partial cross-sectional view of the placement tool of FIG. 12, illustrating an embodiment of the helical drive arrangement between the mandrel and the rotatable centralizer, the helical drive arrangement.

With reference to the embodiment of FIG. 13 the displacement tool 12 comprises a helical drive arrangement 125 comprises one or more helical grooves 165, formed along an outer surface of a mandrel 175, and corresponding guide pins 170 equally spaced apart and extending radially inwardly from an inner surface 180 of the centralizer 120. Each of the guide pins 170 are received in their respective helical grooves 165 and follow a travel path defined helical grooves 165, causing the centralizer 120 to travel along the length of the mandrel 115 while concurrently rotating thereabout.

Figure 14A:
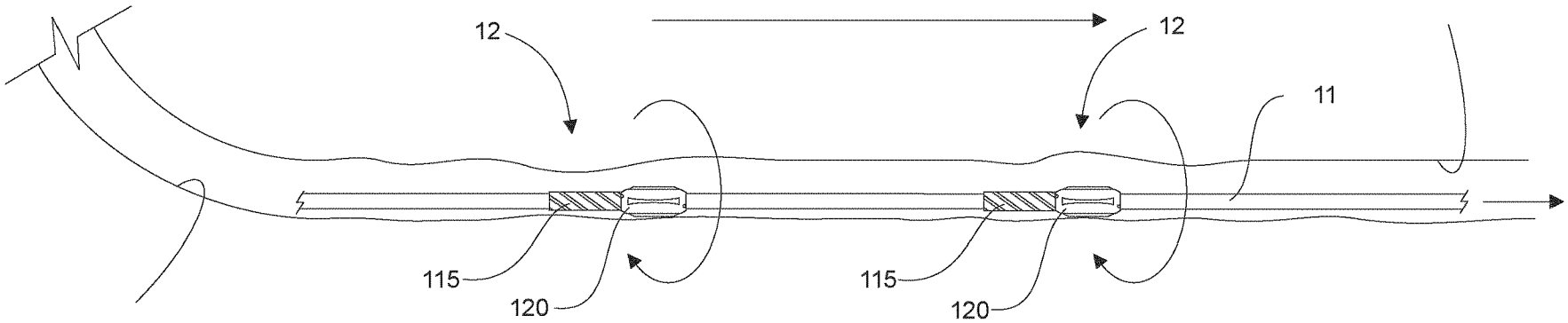
FIGS. 14A and 14B are schematics of positive cement placement tools along an uphole portion of a casing string, wherein in FIG. 14A, the uphole portion is stroked downhole to cause a centralizer sleeve to be rotated in a first direction, and wherein in FIG. 14B, the placement tool is stroked uphole to cause the centralizer sleeve to be rotated in a second opposite direction.
Figure 14B:
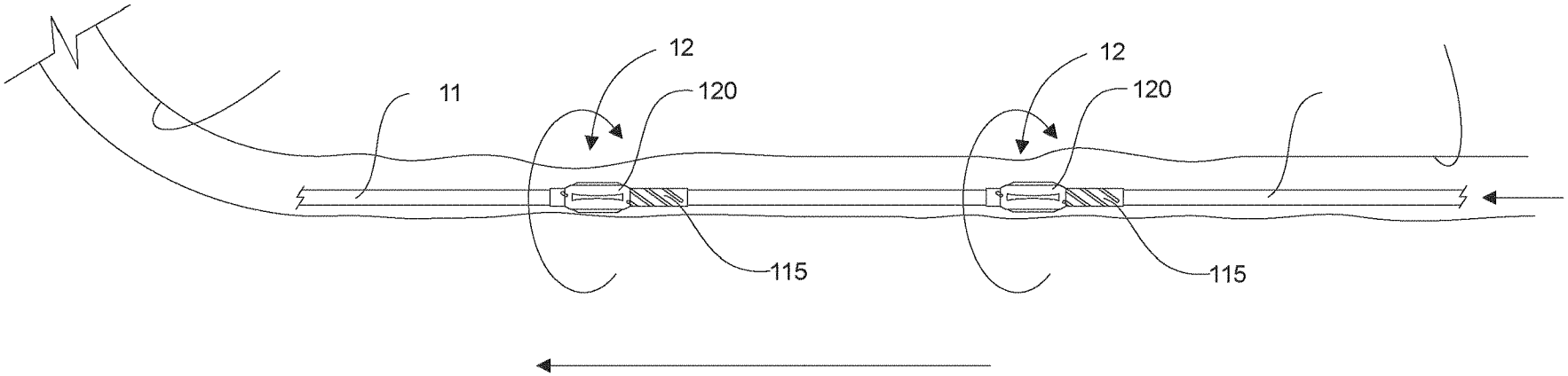

With reference to FIGS. 14A and 14B, stroking the casing string C in one direction (see FIG. 14A downhole) causes the centralizer 120 to rotate about the mandrel 175 in a first direction, providing positive impetus for forcing the cement slurry ahead of the radial guides 30 from one circumferential location to another circumferential location about the displacement tool 12. The longitudinal travel of the casing string C and of the centralizer 120 along the mandrel 115 of tool 10 provides positive impetus for forcing or pushing the cement slurry axially along the tool 10 and along the casing string. Stroking of the casing string C in the opposite direction (see FIG. 14B uphole) drives the centralizer 120 to rotate about the mandrel 115 in a second opposite direction, once again forcing cement slurry about the tool 12. Continued longitudinal travel of one or more centralizers 120 along their respective mandrels 115 in the opposite direction forces the cement slurry to be pushed axially along the casing string in the opposite direction.

Accordingly, the reciprocating action of the uphole portion 11 of the casing string C, regardless of the fixed arrangement of the downhole portion of the casing string C in the wellbore W, distributes or places cement about the casing string The embodiments of the invention for which an exclusive property or privilege is claimed are as follows:

1. A method for placing cement in an annulus about a casing string completed in a wellbore, the casing string having an uphole portion located uphole of a downhole portion; the method comprising:

spacing one or more cement placement tools along the uphole portion;

running the casing string into the wellbore for positioning the lower portion;

placing cement through the uphole portion and into the casing annulus along the upper portion of the casing;

reciprocating the upper portion relative to the lower portion to place the cement thereabout;

wherein one or more of the placement tools are centralizers, further comprising each centralizer actuating the centralizer through the reciprocation of the uphole casing for rotating thereof.

2. The method of claim 1 wherein before running the casing string into the wellbore, further comprising locating a telescopic joint between the uphole portion and the downhole portion; and wherein the reciprocating of the uphole portion relative to the downhole portion comprises reciprocating the telescopic joint.

3. The method of claim 2 wherein:

wherein before running the casing string into the wellbore, further comprising locating a staging tool between the uphole and downhole portions of the casing string with the telescopic joint uphole of the staging tool between the uphole portion and the downhole portion, and further comprising:

actuating the staging tool to block the downhole portion of the casing string from the uphole portion; and placing cement through the uphole portion and out of the staging tool into the casing annulus along the upper portion of the casing.

4. A telescopic casing tool positioned intermediate an uphole portion and a downhole portion of a casing string, the tool comprising:

an inner mandrel having a first bore adapted to be fluidly connected with the casing string;

an outer sleeve having a second bore adapted to be fluidly connected with the casing string, the second bore of the outer sleeve being telescopically slidable about the inner mandrel between fully retracted and extended positions;

a sealing sub at a sliding end of the outer sleeve and forming a sealing annulus between the sealing sub and the inner mandrel, and within the sealing annulus, further comprising:

two or more sliding elements spaced axially apart;

sealing elements sandwiched axially between two of the two or more sliding elements; and wiper seals adjacent uphole and downhole ends of the sealing sub.

5. The telescopic tool of claim 4 wherein:

the inner mandrel is connected to the downhole portion of the casing string; and the outer sleeve is connected to the uphole portion of the casing string.

6. The telescopic tool of claim 4 wherein the sealing elements are lip-type piston rod seals.

7. The telescopic tool of claim 4 further comprising:

a locking mechanism between the outer sleeve and inner mandrel for co-rotation of the uphole and downhole portions in the fully retracted position and released for rotation in the extended position.

8. The telescopic tool of claim 7 wherein:

a coupling end of the inner mandrel is fit with a casing coupling, and the locking mechanism is fit between the sealing sub and coupling end.

9. The telescopic tool of claim 8 wherein:

the sliding end of the outer sleeve is with a first clutch profile and the coupling end of the inner mandrel is with a second complementary profile for co-rotation of the uphole and downhole portions in the fully retracted position and released for rotation in the extended position.

10. A telescopic casing tool positioned intermediate a uphole portion and a downhole portion of a casing string, the tool comprising:

an inner mandrel having a first bore adapted to be fluidly connected with the casing string;

an outer sleeve having a second bore adapted to be fluidly connected with the casing string, the second bore of the outer sleeve being telescopically slidable about the inner mandrel between fully retracted and extended positions; and a locking mechanism between the outer sleeve and inner mandrel for co-rotation of the uphole and downhole portions in the fully retracted position and released for rotation in the extended position;

wherein a sliding end of the outer sleeve is fit with a sealing sub;

wherein a coupling end of the inner mandrel is fit with a casing coupling; and wherein the locking mechanism is fit between the sealing sub and coupling end.

11. The telescopic tool of claim 10 further comprising:

wherein the inner mandrel is connected to the downhole portion of the casing string; and the outer sleeve is connected to the uphole portion of the casing string.

12. The telescopic tool of claim 10 further comprising seals at the sliding end of the outer sleeve for sealing between the outer sleeve and the inner mandrel.

13. The telescopic tool of claim 10 wherein:

the sealing sub forms a sealing annulus between the sealing sub and the inner mandrel, and within the sealing annulus, further comprising:

two or more sliding elements spaced axially apart;

sealing elements sandwiched axially between two of the two or more sliding elements; and wiper seals adjacent uphole and downhole ends of the sealing sub.

14. The telescopic tool of claim 13 wherein the sealing elements are lip-type piston rod seals.

15. The telescopic tool of claim 10 wherein:

the sliding end of the outer sleeve is with a first clutch profile and the coupling end of the inner mandrel is with a second complementary profile for co-rotation of the uphole and downhole portions in the fully retracted position and released for rotation in the extended position.

* * * * *